US008220674B2

(12) United States Patent
Liscano

(10) Patent No.: US 8,220,674 B2
(45) Date of Patent: Jul. 17, 2012

(54) CLOSET HANGER

(76) Inventor: Tanya Liscano, Clovis, CA (US)

( * ) Notice: Subject to any disclaimer, the term of this patent is extended or adjusted under 35 U.S.C. 154(b) by 0 days.

(21) Appl. No.: 12/454,352

(22) Filed: May 15, 2009

(65) Prior Publication Data

US 2010/0288799 A1 Nov. 18, 2010

(51) Int. Cl.
*A41D 27/22* (2006.01)

(52) U.S. Cl. ..... 223/85; 223/92

(58) Field of Classification Search ..... 223/85, 223/86, 88, 92, 95, DIG. 4; 400/322; 40/322
See application file for complete search history.

(56) References Cited

U.S. PATENT DOCUMENTS

| | | | | | |
|---|---|---|---|---|---|
| 2,426,952 | A * | 9/1947 | Sloan | 223/86 |
| 2,690,863 | A * | 10/1954 | Adelman | 40/322 |
| 3,392,891 | A * | 7/1968 | Gingher | 223/85 |
| 4,487,343 | A * | 12/1984 | Chen | 223/85 |
| 4,517,709 | A * | 5/1985 | Arentsen et al. | 223/85 |
| 4,895,283 | A * | 1/1990 | Evangelist et al. | 223/94 |
| 5,056,248 | A * | 10/1991 | Blanchard | 40/322 |
| 5,381,938 | A * | 1/1995 | Vasudeva | 223/85 |
| 5,411,189 | A * | 5/1995 | Gouldson | 223/85 |
| 5,432,956 | A * | 7/1995 | Park | 4/239 |
| 5,573,151 | A * | 11/1996 | Fildan | 223/85 |
| 5,649,651 | A * | 7/1997 | Lam | 223/85 |
| 6,036,062 | A * | 3/2000 | von Fabris auf Mayerhofen | 223/85 |
| 6,085,950 | A * | 7/2000 | Gouldson et al. | 223/85 |
| 6,263,524 | B1 * | 7/2001 | Abdul | 4/615 |
| 6,959,458 | B1 * | 11/2005 | Tsai | 4/234 |
| 2007/0029354 | A1 * | 2/2007 | Hunt et al. | 223/85 |
| 2007/0257071 | A1 * | 11/2007 | Gouldson | 223/85 |

* cited by examiner

*Primary Examiner* — Nathan Durham
(74) *Attorney, Agent, or Firm* — Richard A. Ryan

(57) ABSTRACT

An improved closet hanger for use to hang clothes on a closet bar in a closet that is more attractive than prior art hangers. The closet hanger has an upper section, having a hook member configured to engage the closet bar and a neck, and a lower section, having a hanger body connected to the neck, that supports the clothes. At least the upper section is made from a transparent acrylic material and has a design element, comprising one or more design objects, incorporated therein that it is visible above the clothes hanging on the hanger body. The clothes hanger can include a design plate attached to or integral with the upper section. The design element can be in the design plate or the design plate can comprise a second design element having a theme corresponding or contrasting the theme of the design element in the hook member and/or neck.

16 Claims, 2 Drawing Sheets

CLOSET HANGER

CROSS-REFERENCE TO RELATED APPLICATIONS

None.

STATEMENT REGARDING FEDERALLY SPONSORED RESEARCH

Not Applicable.

BACKGROUND OF THE INVENTION

A. Field of the Invention

The field of the present invention relates generally to closet hangers utilized to hang clothes on a closet rod, bar or the like. More particularly, the present invention relates to closet hangers that are configured to be decorative so as to provide a more attractive closet.

B. Background

Virtually every person utilizes closet hangers to hang clothes on a closet bar or rod that spans the closet above the closet floor. The typical closet bar/rod is cylindrical. Closet hangers allow the person to place their clothes in a hanging position when they are not wearing or cleaning the clothes. Generally, hanging clothes on a clothes hanger is considered to be better for the clothes and less likely to result in wrinkled or dirty clothes than other means of storing clothes. Absent clothes hangers and their associated closet rod, persons would have to fold the clothes and place them inside a dresser, container or the like or stack the clothes on the floor or on a chair or other piece of furniture.

Although a clothes hanger is generally considered to be very useful and beneficial device on which to store clothes, clothes hangers are notoriously boring and unattractive. It is not uncommon for people to spend significant sums of money remodeling their closets to improve the functionality and appearance of the closet. Despite the improvements which can be made to a closet, the closet owner must nevertheless utilize standard clothes hangers on which to hang his or her clothes. As a result, when such a person looks into his or her closet, they will see an attractive closet having clothes, often expensive clothes, hanging on clothes hangers which are generally considered unattractive. To reduce the negative visual effect of the clothes hangers some people purchase a complete set of clothes hangers so, at least, the clothes hangers will be uniform. Even persons who have not spent money and/or time remodeling their closet can generally appreciate that the standard clothes hanger is not attractive.

Prior art clothes hangers generally comprise an upper section which hangs on the closet rod and a lower section which supports the clothes as they hang in the closet. Typically, the upper section has a hook member that is shaped to support the hanger on closet rod and a neck that connects to the lower section. The lower section, which are available in a wide variety of shapes and sizes, has a hanger body which is configured to support the clothing that will hang on the hanger. Clothes hangers are manufactured out of metal, plastic, wood and a variety of other materials. Although some clothes hangers are covered in fabric or other cloth or cloth-like covering, most hangers merely comprise the material from which the hanger is formed. Other clothes hangers have the name of the store or clothing company imprinted on the exterior of the clothes hanger, usually on or near the neck of the clothes hanger. Although covered or imprinted hangers are generally more attractive than plain hangers, they are known to have the limitation that the covering and/or the imprint can be damaged by contact with other items in the closet, including but not limited to clothes, other hangers, closet rod and the closet walls, shelves and doors. If the hanger covering or imprint is damaged, then the clothes hanger is likely to be even more unattractive than a plain hanger.

What is needed, therefore, is an improved closet hanger that is attractive to look at while being configured to support clothes on a closet rod or the like. The improved closet hanger should be adaptable to a variety of different hanger configurations and be able to incorporate a variety of different designs to allow a person to select an improved hanger that provides the desired look and function that is desired by the person. Preferably, the various design elements should be incorporated in the improved closet hanger in a manner that does not result in the designs being subject to easy removal by contact with other items in the closet. The preferred closet hanger will be relatively easy and inexpensive to manufacture.

SUMMARY OF THE INVENTION

The improved closet hanger of the present invention solves the problems and provides the benefits identified above. That is to say, the present invention is a closet hanger that incorporates one or more design elements into at least the upper section of the hanger to provide a more attractive clothes hanger while being able to support clothes on a closet rod or the like. The improved clothes hanger of the present invention can be manufactured in a wide variety of different hanger configurations to accommodate different sizes and types of clothing and incorporate a wide variety of design elements, thereby allowing a person to select an improved closet hanger that provides the look and function that he or she desires. In a preferred embodiment, the clothes hanger is made from an acrylic or other transparent, relatively damage-proof material with the design element incorporated within the material to protect the design element from damage due to contact with other items in the closet. In the preferred embodiment, the clothes hanger of the present invention is relatively easy and inexpensive to manufacture, which will allow persons to replace their present boring and unattractive hangers with the improved clothes hanger.

In a primary embodiment of the present invention, the improved clothes hanger generally comprises an upper section, a lower section and a design element incorporated into the upper section. The upper section has a hook member configured to engage a closet rod or the like in a closet and the neck connects to the lower section. The lower section, which is attached to or integral with the upper section, has a hanger body which is configured to support clothing. At least the hook member and neck of the upper section is made from a transparent material, such as acrylic or the like. In the preferred embodiment, the entire hanger is made from acrylic and formed integrally. At least one design element, typically made up of a plurality of design objects, is disposed inside the acrylic material that defines at least one of the hook member and/or the neck of the upper section. In one embodiment, the design element is incorporated into both of the hook member and neck. The clothes hanger can also include a design plate that is integral with or attached to the upper section. In a preferred embodiment, the design plate is integrally formed with the upper section, which are all made out of acrylic, and is disposed between the neck and the body member. If desired, the design element can be positioned only in the material that forms the design plate. Alternatively, the design plate can have a second design element inside the acrylic material that forms the design plate. The second design element can have a theme that is in corresponding or contrasting relation with the theme of the design element inside the hook member and/or the neck. A wide variety of different types of design objects can be utilized for the design elements and the design theme or themes can be of virtually any theme that is desired by the user, including but not limited to holiday, seasonal, outdoor or the like. The hanger body can be of virtually any size or configuration desired to support clothing. The improved clothes hanger of the present invention will significantly improve the appearance of a closet.

Accordingly, one of the primary aspects of the present invention is to provide an improved clothes hanger that has the advantages discussed above and which overcomes the disadvantages and limitations associated with presently available clothes hangers.

It is an important aspect of the present invention to provide an improved clothes hanger that provides a more attractive hanger for hanging clothes on a closet rod or the like in a closet than presently available clothes hangers.

It is also an important aspect of the present invention to provide an improved clothes hanger that can utilize a variety of different design elements and which can be configured in a wide variety of different sizes and shapes to accommodate different sizes and types of clothing.

Another important aspect of the present invention is to provide a clothes hanger that includes one or more design elements in at least the upper section of the hanger in a manner that substantially reduces the likelihood that the design element will be damaged by contact with other items in the closet.

Yet another important aspect of the present invention is to provide an improved closet hanger that is relatively easy and inexpensive to manufacture so that it can be utilized to replace a person's present clothes hangers.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain configurations for the components of the improved clothes hanger, those skilled in the art will readily understand that this is merely for purposes of simplifying the present disclosure and that the present invention is not so limited.

Figure 1:
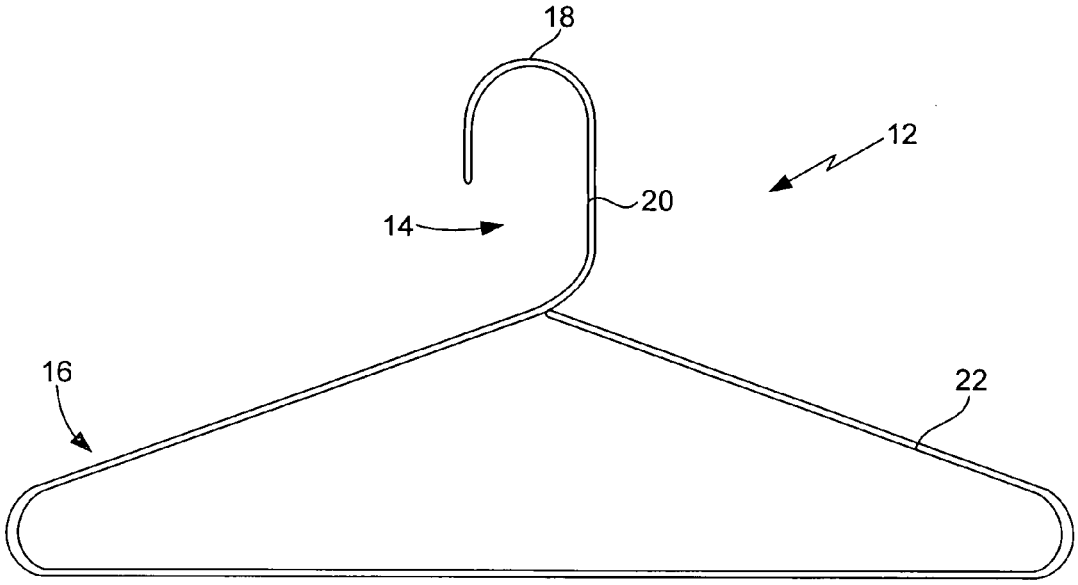
FIG. 1 (PRIOR ART)
FIG. 1 is a front view of a prior art clothes hanger.
Figure 2:
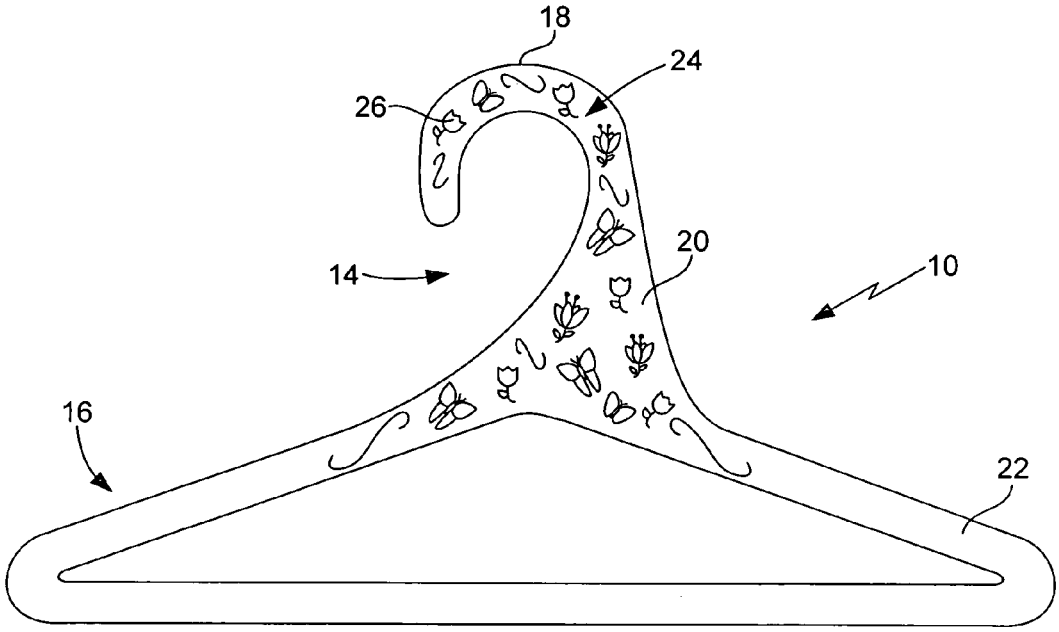
FIG. 2 is a front view of an improved clothes hanger that is configured according to a preferred embodiment of the present invention.
Figure 3:
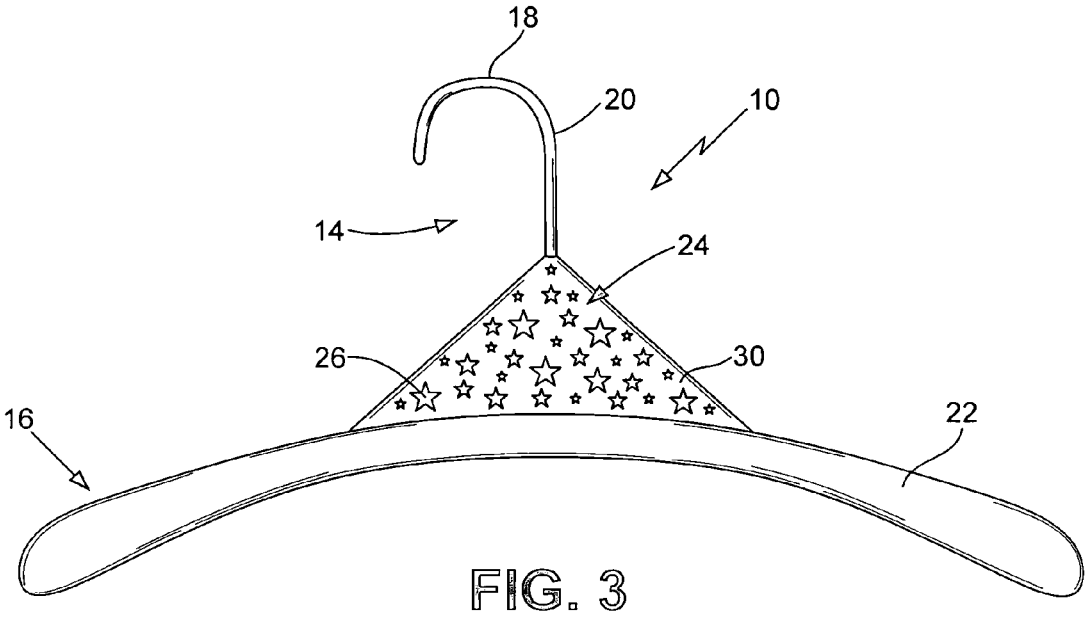
FIG. 3 is a front view of an alternative configuration for the improved clothes hanger of the present invention.
Figure 4:
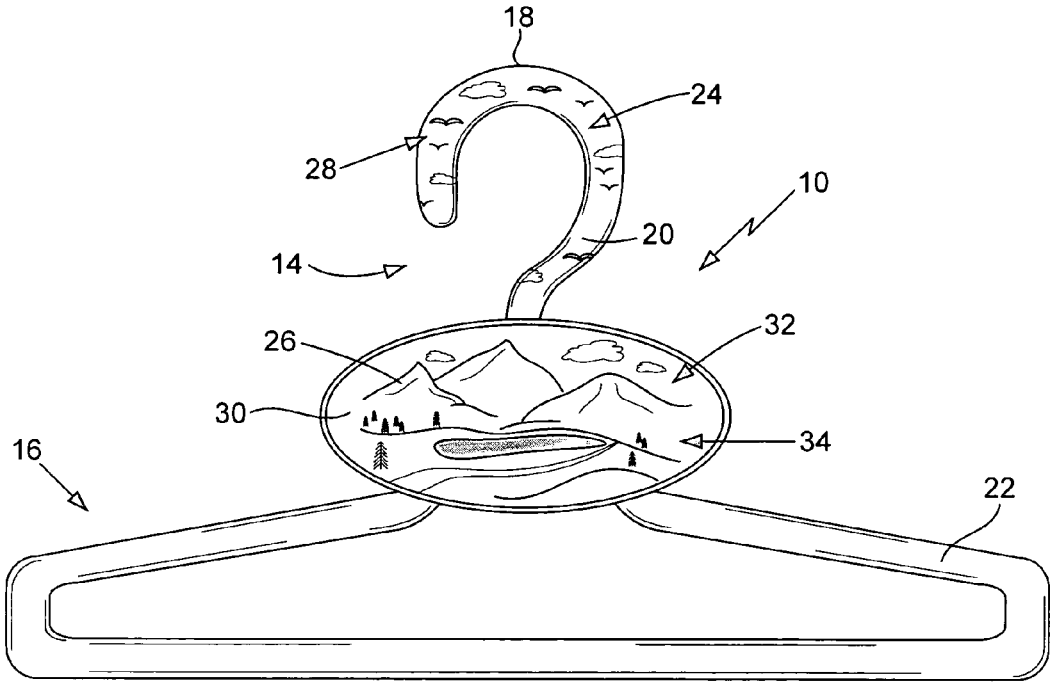
FIG. 4 is a front view of another alternative configuration for the improved clothes hanger of the present invention.

An improved clothes hanger that is configured pursuant to a preferred embodiment of the present invention is identified generally as 10 in FIGS. 2 through 4. A prior art hanger, identified as 12, is shown in FIG. 1. As well known in the art, prior art hanger 12 generally comprises an upper section 14 and a lower section 16. The upper section 14 includes hook member 18 that is configured to be received on a closer rod or the like (not shown) to support the clothes hanger 12 and any clothes supported by clothes hanger 12 and a neck 20 that interconnects the hook member 18 to lower section 16. The lower section 16 comprises body member 22 that is shaped and configured to engage and support a clothing item so it may hang in the closet from the closet rod. Typically, hook member 18, neck 20 and body member 22 are integrally formed and they are manufactured from a wide variety of different materials, including metal, plastic, wood and the like. As set forth above, while the prior art clothes hangers 12 are well known and capable of supporting clothes on a clothes rod, the are generally boring and unattractive. In a closet full of clothes, many of which may be very nice and/or inexpensive, the boring and unattractive prior art clothes hangers 12 stand out in a negative manner. If the closet itself has been remodeled or is otherwise made attractive, the prior art clothes hangers 12 are even more of a negative impact in the closet.

The improved closet hanger 10 of the present invention, different embodiments of which are shown in FIGS. 2 through 4, is generally configured in much the same manner as the prior art clothes hanger 12 described above. The improved closet hanger also comprises an upper section 14 having hook member 18 and neck 20 and a lower section 16 having hanger body 22. In the preferred embodiment, the improved clothes hanger 10 is manufactured from a generally tough and transparent material such as polymethyl methacrylate (PMMA), which is commonly referred to as acrylic glass or just acrylic, or similarly configured and generally equivalent plastic materials or the like. As well known in the art, acrylic as the benefit of being generally scratch and other damage resistant, a relatively inexpensive material and relatively easy to work with to form objects therefrom, such as improved clothes hanger 10. As set forth below, at least the upper section 14 of clothes hanger 10 should be made out of acrylic or an equivalent material. While the lower section can be manufactured out of metal, wood, standard plastic or other non-acrylic materials, it will generally be much more efficient and less expensive to integrally form upper section 14 and lower section 16 of clothes hanger 10 from acrylic. The hanger body 22 of lower section 16 can have a variety of different configurations, such as those shown in the figures, to be suited to a variety of different types and sizes of clothing.

As shown in FIGS. 2 through 4, incorporated inside the acrylic upper section 14 are one or more design elements 24. The design element 24 can be any type of design feature, typically having a plurality of design objects 26, that a person may want to utilize to improve the appearance of the closet. The design elements 24 can be utilized anywhere in the upper section 14, including both of the hook member 18 and neck 20 as shown in FIG. 2, where it will generally be visible above the clothes that hang on the hanger body 22 of lower section 16. If desired, the design element 24 can be relatively random design objects 26 or it can have a theme. In FIG. 2, the design objects 26 of design element 24 include flowers, butterflies and several design shapes, which as may be considered somewhat random or a spring-like theme, shown generally as 28, that can be utilized to decorate the closet with a spring flair. In FIG. 3, the design objects 26 are stars, which can be an Independence Day theme 28 or a space/universe theme 28, particularly if it includes planets and the like and/or the stars are made out of a photoluminescence or glow-in-the-dark material. In FIG. 4, the design objects 26 are birds and clouds that provides an outdoor type of theme 28.

As shown in FIGS. 2 and 4, design element 24 can be incorporated into the structure, meaning formed inside the acrylic or other material, of the hook element 18 and neck 20 of the upper section 14. If desired, the improved clothes hanger 10 of the present invention can also include a design plate 30 that is also made out of acrylic or the like and is integrally formed with, which is preferred, or attached to upper section 14. In FIGS. 3 and 4, the design plate 30 is disposed between the neck 20 and the hanger body 22 and, like the remaining portion of upper section 14, will be visible above the clothes that are hanging on the hanger body 20. In the clothes hanger 10 of FIG. 3, design element 24 is incorporated only into the material that forms design plate 30. In the embodiment shown in FIG. 4, the improved clothes hanger 10 has the design element 24, having theme 28, incorporated into the material forming hook 18 and neck 20 and has a second design element 32, having a second theme 34, incorporated into the material that forms design plate 30. In the preferred embodiment, the design theme 34 of the second design element 32 is in at least generally corresponding relation to the design theme 28 of the first design element 24, as shown with the outdoor/nature themes in FIG. 4. If desired, however, the design themes 28 and 34 can be contrasting. The design elements 24 and 32 can be provided in a variety of colors, which will generally be selected to correspond to the design themes 28 and 34.

As stated above, in the preferred embodiment at least the upper section 14 of improved clothes hanger 10 is integrally formed out of acrylic or like material with the design element 24/32 incorporated inside the material. Because the material is transparent, the design element 24/32 will be visible above the clothes that are hanging on the hanger body 22 of lower section 16. The acrylic material will prevent damage to the design elements 24/32. In use, the user will utilize the improved clothes hanger 10 in the same manner in which he or she presently uses the prior art clothes hanger 12, namely hang the clothes on the hanger body 22 and then place the hook element 18 on the closet rod in the closet. The difference will be that the user's closet will be much more attractive and enjoyable to be in with the improved clothes hanger 10 than with the boring and unattractive prior art clothes hangers 12.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to various modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A clothes hanger, comprising:

an upper section having a hook member and a neck, each of said hook member and said neck of said upper section formed from a transparent material;

a lower section integral with or attached to said upper section, said lower section having a hanger body; and at least one decorative design element disposed in said transparent material of said hook member, said design element fully encapsulated by said transparent material so as to be integral therewith, said design element selected so as to improve the appearance of said clothes hanger without providing any structural reinforcement for said clothes hanger.

2. The clothes hanger of claim 1, wherein said design element is disposed in and fully encapsulated by said transparent material of each of said hook member and said neck.

3. The clothes hanger of claim 2 further comprising a design plate in said upper section, said design plate entirely formed from said transparent material and having a second design element disposed in and fully encapsulated by said transparent material of said design plate.

4. The clothes hanger of claim 3, wherein said design element in said hook member or said neck has a first design theme and said second design element has a second design theme that is in corresponding relation to the first design theme.

5. The clothes hanger of claim 1 further comprising a design plate in said upper section, said design plate entirely formed from said transparent material and having a second design element disposed in and fully encapsulated by said transparent material of said design plate.

6. The clothes hanger of claim 5, wherein said design element in said hook member or said neck has a first design theme and said second design element has a second design theme that is in corresponding relation to the first design theme.

7. The clothes hanger of claim 1, wherein said transparent material is acrylic.

8. A clothes hanger, comprising:

an upper section having a hook member, a neck and a design plate, each of said hook member, said neck and said design plate of said upper section formed from a transparent material;

a lower section integral with or attached to at least one of said neck and said design plate of said upper section, said lower section having a hanger body; and at least one design element disposed inside said transparent material of at least one of said hook member, said neck and said design plate, said design element fully encapsulated by said transparent material so as to be integral therewith, said design element selected so as to improve the appearance of said clothes hanger without providing any structural reinforcement for said clothes hanger.

9. The clothes hanger of claim 8, wherein said transparent material is acrylic.

10. The clothes hanger of claim 8, wherein said design element is disposed in and fully encapsulated by said transparent material of each of said hook member, said neck and said design plate.

11. The clothes hanger of claim 10, wherein said hook member and said neck have a first design element with a first design theme and said design plate has a second design element with a second design theme.

12. The clothes hanger of claim 11, wherein said second design theme is in corresponding relation to said first design theme.

13. The clothes hanger of claim 12, wherein said transparent material is acrylic.

14. A clothes hanger, comprising:

an upper section having a hook member and a neck, each of said hook member and said neck of said upper section formed from a transparent material;

a lower section integral with or attached to said upper section, said lower section having a hanger body; and at least one decorative design element disposed in said transparent material of at least one of said hook member and said neck, said design element fully encapsulated by said transparent material so as to be integral therewith, said design element selected so as to improve the appearance of said clothes hanger without providing any structural reinforcement for said clothes hanger.

15. The clothes hanger of claim 14 further comprising a design plate in said upper section, said design plate entirely formed from said transparent material and having a second design element disposed in and fully encapsulated by said transparent material of said design plate.

16. The clothes hanger of claim 15, wherein said design element in said hook member or said neck has a first design theme and said second design element has a second design theme that is in corresponding relation to the first design theme.

* * * * *